US005993282A

United States Patent [19]

Ernst

[11] Patent Number: 5,993,282

[45] Date of Patent: Nov. 30, 1999

[54] TOY CUBE SET

[76] Inventor: Max Ernst, Toesstalstrasse 58, Raemismuehle, Switzerland, CH-8487

[21] Appl. No.: 08/925,986

[22] Filed: Sep. 9, 1997

[30] Foreign Application Priority Data

Sep. 20, 1996 [CH] Switzerland ..... 02316/96

[51] Int. Cl.[6] ..... A63H 33/04

[52] U.S. Cl. ..... 446/124; 446/85

[58] Field of Search ..... 446/69, 85, 120, 446/124, 127, 128

[56] References Cited

U.S. PATENT DOCUMENTS

| | | | |
|---|---|---|---|
| 3,611,621 | 10/1971 | Folson | 446/124 |
| 4,185,411 | 1/1980 | Fischer | 446/124 |
| 4,305,221 | 12/1981 | Chatani | 446/124 |
| 5,538,452 | 7/1996 | Kurani | 446/102 |

FOREIGN PATENT DOCUMENTS

| | | | |
|---|---|---|---|
| 476955 | 3/1992 | European Pat. Off. | 446/124 |
| 2484855 | 12/1981 | France | 446/124 |
| 2593717 | 8/1987 | France | 446/128 |
| 245127 | 4/1987 | Germany | 446/127 |

*Primary Examiner*—Robert A. Hafer
*Assistant Examiner*—Laura Fossum
*Attorney, Agent, or Firm*—Karl Hormann

[57] ABSTRACT

A component set for assembling toy cubes made up of a first member having a square bottom and square side walls extending from the edges of the bottom member in a direction normal thereto and a second member made up of a square lid and side walls extending similarly therefrom, the second member being of similar shape as the first member but dimensioned to fit into the cavity formed by the bottom and side walls. The first and second members are provided with recesses or slots extending from free edges thereof and protrusions to be received by the recesses or slots. When the second member is inserted into the first member the slots or other openings will form openings penetrating the center of each side wall. Some of the bottoms and lids have cylindrical protrusions extending from their center and dimensioned to fit into the openings, and some of the bottom and lids may have apertures similar to those in the side walls.

13 Claims, 2 Drawing Sheets

TOY CUBE SET

BACKGROUND OF THE INVENTION

1. Field of the Invention

The invention, in general, relates to a toy cube set, and, more particularly, to toy cube sets each individual cube of which is made from a plurality of components and which may be combined with similar cubes to form more complex three-dimensional structures.

2. State of the Art.

Toys, sometimes billed as educational toys, made up of a plurality of components which may be assembled into various structures are well-known in the art.

OBJECTS OF THE INVENTION

It is an object of the present invention to provide a modular set of components which can be assembled into cubes.

More particularly, it is an object of the invention to provide a set of components which may be assembled, permanently or temporarily, into cubes of the kind which may in turn be connected with similar cubes.

Still another object of the invention is to provide a set of components which may be assembled into cubic structures provided with simple means for connecting them to similar cubic structures.

Other objects will in part be obvious and will in part appear hereinafter.

BRIEF SUMMARY OF THE INVENTION

In the accomplishment of these and other objects, the invention, in a preferred embodiment thereof, provides for a set of components which may be assembled into a substantially hollow cube and which comprises a plurality of external components and a plurality of internal components insertable into the external components. Each external component comprises a square bottom portion with edges of a predetermined length, and four first side walls of square configuration extending normal to the bottom portion. Each first side wall is provided with an aperture having a semi-circular margin disposed in the direction of the bottom portion and having a center coinciding with the center of the first side wall. Also, each side wall is provided in its internal surface with an elongate recess of predetermined width which is centered on the free edge of the first side wall and extends to said aperture.

Each internal component comprises a square lid portion with second side walls extending normal thereto for insertion between and flush mounting relative to the first side walls. Each second side wall comprises an aperture having a semi-circular margin disposed in the direction of the lid portion and having a diameter identical to that of the aperture in each first side wall. The center of the semi-circular aperture in each second side wall is positioned at half the length of the edges of the first side walls. Each second side wall is in its outer surface provided with an elongate protrusion complementing the configuration and disposition of the recesses in the first side walls.

BRIEF DESCRIPTION OF THE SEVERAL DRAWINGS

The novel features which are considered to be characteristic of the invention are set forth with particularity in the appended claims. The invention itself, however, in respect of its structure, construction, lay-out and design, as well as manufacturing techniques, together with other objects and advantages thereof, will be best understood from the following description of preferred embodiments when read with reference to the appended drawings, in which:

DETAILED DESCRIPTION OF PREFERRED EMBODIMENTS.

Figure 11:
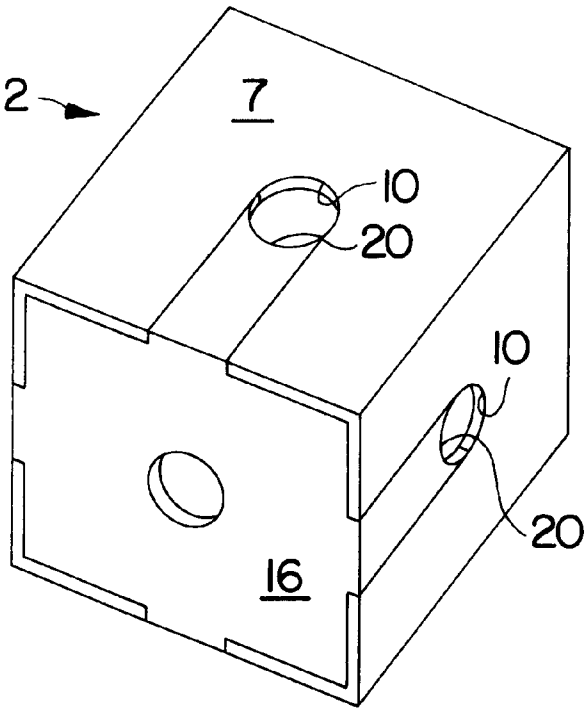
FIG. 11 is a perspective view of the components of FIG. 10 in their fully assembled state.
Figure 10:
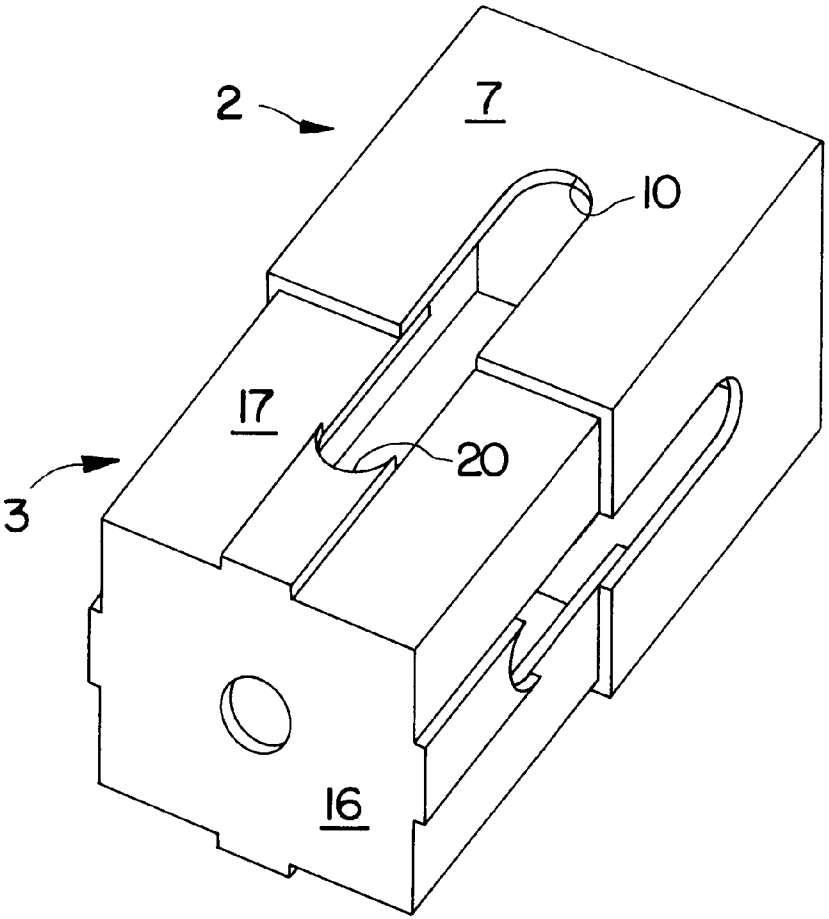
FIG. 10 is a perspective view of the components shown in FIGS. 5 and 7 just prior to their assembled state.

A cube (FIG. 11) in accordance with the invention is made up of an external part 2 and an inserted internal part 3. The parts 2 and 3 may be made, for instance, from a suitably resilient polymeric resin or wood. The external part 2 is seen to have a bottom 4 with a substantially square outer surface 5 and four side walls 6 integral therewith. The external surfaces 7 of the side walls 6 are of square configuration as well, its edges being of a dimension a. It will be assumed that the wall thickness of the bottom as well as of the side walls is uniform throughout. An elongate slot 8 is provided in each of the side walls 6 extending from the center of the free edge 9 thereof and terminating in a semi-circular portion 10. The center of the semi-circular section 10 coincides with the center of the respective outer surface 7. Extending beyond the slot 8, there is provided at the inner surface of each side wall 6 a clamping flange 11 of the same width as the slot 8.

The slot 8 may, if desired, be replaced by a groove (not shown) of a depth less than the thickness of the respective side wall 6. In such an arrangement the groove would terminate in a round bore the center of which coincides with the center of the external surface of the side wall 6.

The internal part 3 is provided with square lid 15 having an external surface 16 which in the assembled state of the cube is flush with the edges 9 of the external side walls 6. For side walls 17 are extending at a right angle from the lid 15 which may be inserted between the side walls 6 in intimate contact therewith. The wall thickness of the lid and of the side walls 17 will be assumed to be uniform throughout and to be the same as that of the wall thickness external part 2. Each side wall 17 is provided with a central slot 19 extending from the free edge 18 and terminating in a semi-circular section 20. The center of the semi-circular section 20 is at a distance a/2, i.e. half the length of an edge a. In the assembled state of the cube, the semi-circular sections 20 and 10 will complement each other and form a circular opening in the center of the outer surface 7. Extending beyond the semi-circular section 20 and on the exterior surface of the walls 17 there is provided a clamping flange 21 complementing the slot 8 or recess, as the case may be, in the external part 2. Commensurately, the slot 19 or, alternatively, a recess will complement and engage the clamping flange 11 in the external part 2. It will be understood that the clamping flanges 21 will be flush with the surrounding external surface 7 of the side wall 6.

It will be understood that in case the external part 2 is provided with central bores in its side surfaces 6 instead of the slots 8 shown, the internal parts 3 may be similarly provided with bores (also not shown) which in the assembled state of the cube will be coaxially aligned with the bores in the external part 2.

Figure 1:
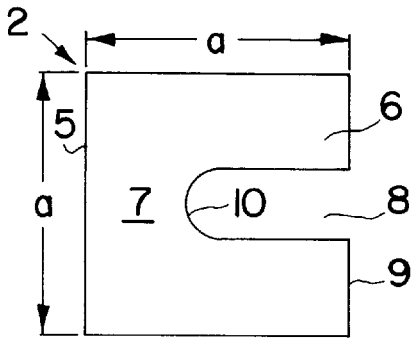
FIGS. 1 to 4 are side elevations of four components of a cube in accordance with the invention.
Figure 2:
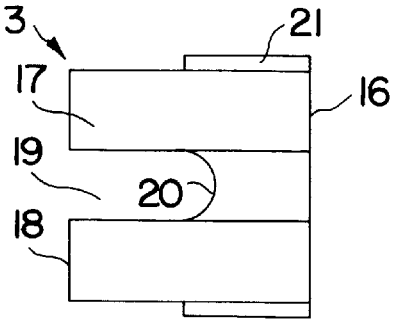
Figure 3:
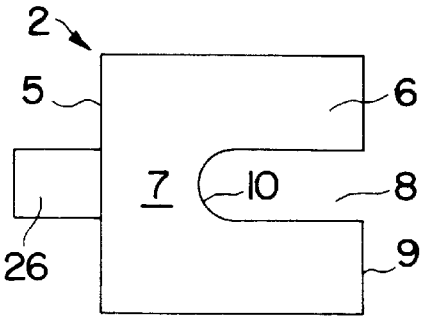
Figure 4:
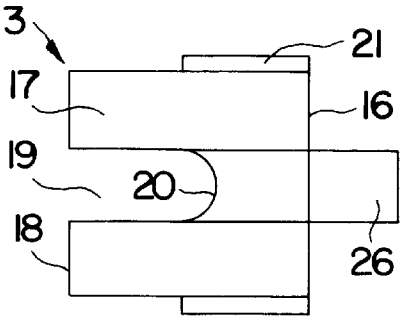
Figure 5:
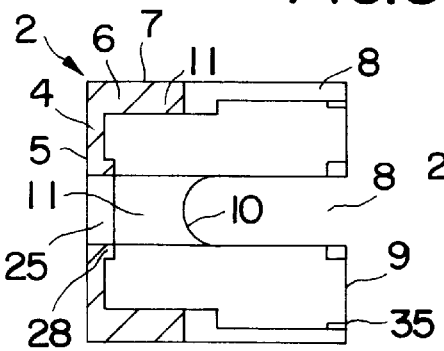
FIGS. 5 to 7 are longitudinal sections through three of the components, or parts thereof, of FIGS. 1 to 4.
Figure 6:
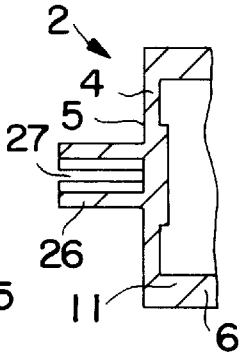
Figure 7:
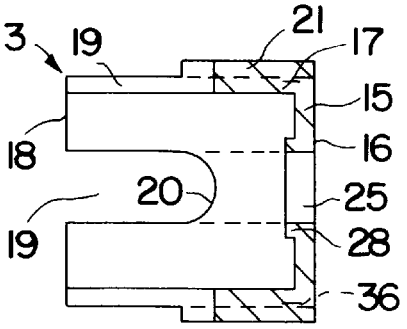

A plurality of the internal parts 3 of the set are provided with a throughbore 25 (FIG. 7) positioned centrally of the lid 15. The diameter of these bores equals the diameters of the semi-circular sections 10 and 20. The set may further be provided with additional internal parts 3 which instead of a bore 25 are provided with centrally placed pegs 26 of about the same or a somewhat larger diameter than the throughbores 25 (FIG. 4). Preferably, the peg 26 is a tubular member and is provided with at least one elongate slot 27 (FIG. 6). Thus, the strength of attachment of the pegs 26 within the bores 25, 10, 20 is increased. A plurality of the external parts 2 as well are provided at the internal surface of their bottom 4 with a central bore 25 of the same diameter. At the interior surface of their bottom 4 or lid 15, the bores 25 are preferably provided with an annular reinforcement 28. A plurality of other external parts 2 may also be provided with a bore 25 instead of with an integral peg 26 (FIG. 6). The bottoms 4 and the lids 15 may also be provided with disk-like reinforcements 28 disposed coaxially with respect to the pegs 26.

Figure 8:
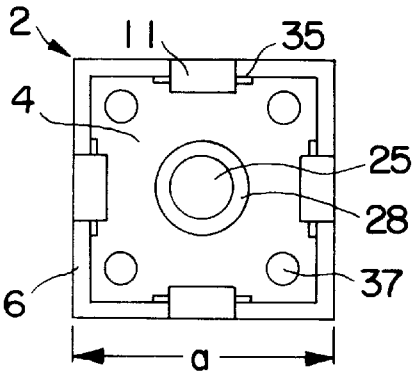
FIGS. 8 and 9 are top elevational views of the open sides of two of the components.
Figure 9:
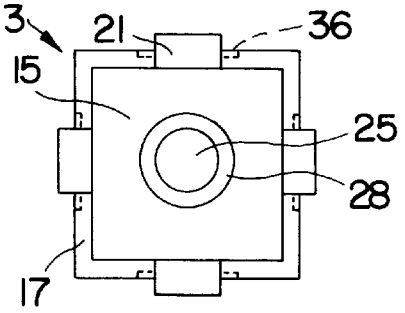

With a view to secure the internal part 3 within the external part 2 at least temporarily, there may be provided, adjacent to the slots 8 or recesses and the edges 9, inwardly facing narrow protrusions 35 for snapping into corresponding recesses 36 in the internal part 2. Such narrow protrusions on elastic wall portions may easily be formed by injection molding processes utilizing a two-part mold. Similar protrusions may, of course, also be formed in wooden components. In the embodiment shown, the parts 2 and 3 will be permanently connected to each other. A different embodiment offering an improved connection between the parts 2 and 3 is shown in FIG. 8 and is provided with protrusions 37 integral with its bottom 4. The walls 17 may be clamped between those protrusions 37 and the walls 6. It will be understood by those skilled in the art that the snap or clamping connection between the external and internal components 2 and 3 may also be structured as a releasable one.

Preferably, the component set is supplied with the cubes in their unassembled condition, for it is easy and very likely enjoyable for children to assemble the cubes themselves. In that manner manufacturing costs are reduced and the set may be offered at a cheaper price. Moreover, assuming the component to be differently colored, a child may enjoy assembling the components in different and stunning color combinations. It would also be possible to use the external parts 2 only, without any internal parts 3, with the slots 8 representing doors, for instance.

The described modular set and cubes made from its components are very attractive toys, for they make possible three-dimensional structures in which interconnected components may be rotated about the axis of the pegs 26. In that manner, a child can construct and alter amazingly variegated structures. A cube assembled from an external and an internal part 2 and 3 represents the basic module of the component set. The set may additionally be furnished with roof-shaped elements and cylindrical staves or sticks in dimensions commensurate with the cubes for assembly therewith by plugging into their bores 25 or snapping onto their pegs 26.

What is claimed is:

1. A component set for making a toy cube, comprising:

a first member comprising a bottom portion of substantially square configuration and first side wall members of substantially the same square configuration as the bottom portion, the bottom portion and the first side wall members being of identical thickness, the first side wall members engaging lateral edges of the bottom portion and extending normal to a surface or the bottom portion thereof and in lateral engagement with each other, each first side wall member having formed therein a first opening with a first substantially semi-circular portion pointing in the direction of the bottom portion and a first elongate recess of predetermined width extending along the interior surface of said wall members from the free edge of each first side wall member to the opening, the center of the first semi-circular portion coinciding with the center of the first side wall member and the center line of the elongate recess coinciding with the center line of the free edge of the first side wall member;

a second member comprising a lid portion of substantially square configuration and second side wall members engaging lateral edges of the lid portion and extending normal to the surface of the lid portion thereof in lateral engagement with each other, the length of the edges of the lid portion being equal to the length of the edges of the bottom portion less twice the wall thickness thereof and the length of the edges of the second side wall portions extending from the lid portion being equal to the length of the edges of the bottom portion less the wall thickness thereof, each second side wall member forming a second opening having a second semi-circular portion pointing in the direction of the lid portion and a first elongate protrusion on its external surface extending substantially from the edge of the lid portion to the opening and complementing the elongate recess, the center of the second semi-circular portion being at half the length of the edge of the lid portion and, measured from the free edge of the second side wall, at half the length of the edge of the bottom portion less the thickness thereof; and wherein said first and second members are configured for internesting in a state in which surfaces and edges of the outer surface of the resultant internested cube are flush, interrupted only by one of a resultant central opening in each surface and a center protrusion.

2. The component set of claim 1, wherein the first elongate recess in each first side wall member is a slot ending in the first semi-circular portion and wherein a second protrusion is provided on each first side wall member on the interior surface thereof between the first opening and the interior surface of the bottom member.

3. The component set of claim 2, wherein each second side wall member is provided with a second elongate recess in its outer surface extending from the center of its free edge to the second opening and complementing the structure of the second protrusion.

4. The component set of claim 3, wherein the second elongate recess is a slot.

5. The component set of claim 1, wherein the diameters of the first and second semi-circular portions are alike.

6. The component set of claim 5, wherein third and fourth openings are provided in the center of the bottom and lid portions.

7. The component set of claim 6, wherein the diameters of the third and fourth openings are equal to the diameters of the first and second said semi-circular portions.

8. The component set of claim 7, wherein said third and fourth openings are surrounded by annular reinforcement flanges on the interior surface of the bottom and lid portions.

9. The component set of claim 5, wherein a substantially cylindrical protrusion is extending from the center of, and is integral with, the outside surface of the bottom and lid portions.

10. The component set of claim 9, wherein the cylindrical protrusions are tubular and are provided with at least one elongate slit.

11. The component set of claim 9, wherein the diameter of the protrusions substantially equals the diameter of the first and second semi-circular portions.

12. The component set of claim 1, wherein matching snap means is provided in the internal surface of at least one of the first side wall members and in the outside surface of at least one of the second side wall members.

13. The component set of claim 1, further comprising means mounted on the interior surface of the bottom member for clamping the second side wall members.

* * * * *